US007021034B2

(12) United States Patent
Higer et al.

(10) Patent No.: US 7,021,034 B2
(45) Date of Patent: Apr. 4, 2006

(54) DECOUPLED VACUUM PACKAGING APPLIANCE

(75) Inventors: Landen Higer, Alameda, CA (US); Alexandre A. N. Baptista, Dublin, CA (US)

(73) Assignee: Tilia International, Inc., San Francisco, CA (US)

( * ) Notice: Subject to any disclaimer, the term of this patent is extended or adjusted under 35 U.S.C. 154(b) by 0 days.

(21) Appl. No.: 10/874,803

(22) Filed: Jun. 22, 2004
(Under 37 CFR 1.47)

(65) Prior Publication Data

US 2005/0183396 A1 Aug. 25, 2005

Related U.S. Application Data

(60) Provisional application No. 60/492,035, filed on Jul. 31, 2003.

(51) Int. Cl.
*B65B 31/02* (2006.01)

(52) U.S. Cl. ..... 53/512; 53/510

(58) Field of Classification Search ..... 53/79, 53/405, 432–434, 408, 510, 512
See application file for complete search history.

(56) References Cited

U.S. PATENT DOCUMENTS

| | | | |
|---|---|---|---|
| 1,143,579 | A | 6/1915 | Denhard |
| 2,079,069 | A | 5/1937 | Johnson |
| 2,319,011 | A | 5/1943 | Meredith |
| 2,354,423 | A | 7/1944 | Rosenberger |
| 2,421,149 | A | 5/1947 | Hard et al. |
| 2,568,226 | A | 9/1951 | Drake |
| 2,617,304 | A | 11/1952 | Conover |
| 2,749,686 | A | 6/1956 | Lorenz et al. |
| 2,778,171 | A | 1/1957 | Taunton |
| 2,899,786 | A | 8/1959 | Harker |
| 3,038,283 | A | 6/1962 | Unger |
| 3,148,269 | A | 9/1964 | Van Hartesveldt et al. |
| 3,464,256 | A | 9/1969 | Lloyd |
| 3,516,223 | A | 6/1970 | Andersen et al. |
| 3,688,463 | A | 9/1972 | Titchenal |
| 3,699,742 | A | 10/1972 | Giraudi |
| 3,928,938 | A | 12/1975 | Burrell |
| 3,962,847 | A | 6/1976 | Trudel |
| 3,965,646 | A | 6/1976 | Hawkins |
| 4,006,329 | A | 2/1977 | Hellman et al. |
| 4,008,601 | A | 2/1977 | Woods |
| 4,105,491 | A | 8/1978 | Haase et al. |
| 4,164,111 | A | 8/1979 | Di Bernardo |
| 4,208,902 | A | 6/1980 | Kim et al. |
| 4,330,975 | A | 5/1982 | Kakiuchi |
| 4,372,096 | A | 2/1983 | Baum |
| 4,541,224 | A | 9/1985 | Mugnai |
| 4,545,177 | A | 10/1985 | Day |
| 4,549,387 | A | 10/1985 | Marshall et al. |
| 4,561,925 | A | 12/1985 | Skerjanec et al. |
| 4,578,928 | A | 4/1986 | Andre et al. |
| 4,581,764 | A | 4/1986 | Plock et al. |

(Continued)

FOREIGN PATENT DOCUMENTS

| | | | |
|---|---|---|---|
| EP | 0723915 | A1 | 7/1996 |

(Continued)

*Primary Examiner*—Stephen F. Gerrity
*Assistant Examiner*—Hemant M. Desai
(74) *Attorney, Agent, or Firm*—Perkins Coie LLP

(57) ABSTRACT

The foot-print of a vacuum packaging appliance may be decreased by decoupling the appliance into a base component and a movable receptacle unit according to certain embodiments of the invention.

20 Claims, 2 Drawing Sheets

U.S. PATENT DOCUMENTS

| | | | |
|---|---|---|---|
| 4,631,512 | A | 12/1986 | Hishiki et al. |
| 4,641,482 | A | 2/1987 | Metz |
| 4,928,829 | A | 5/1990 | Di Bernardo |
| 4,941,310 | A | 7/1990 | Kristen |
| 5,048,269 | A | 9/1991 | Deni |
| 5,352,323 | A | 10/1994 | Chi |
| 5,461,901 | A | 10/1995 | Ottestad |
| 5,608,167 | A | 3/1997 | Hale et al. |
| D389,847 | S | 1/1998 | Huang |
| 5,712,553 | A | 1/1998 | Hallberg |
| 5,765,608 | A | 6/1998 | Kristen |
| 5,784,862 | A | 7/1998 | Germano |
| 5,825,974 | A | 10/1998 | Hutton |
| 5,893,822 | A | 4/1999 | Deni |
| 6,058,998 | A | 5/2000 | Kristen |
| 6,124,558 | A | 9/2000 | Baumeister et al. |
| 6,256,968 | B1 | 7/2001 | Kristen |
| 6,328,897 | B1 | 12/2001 | Leung |
| 6,467,242 | B1 | 10/2002 | Huang |
| 6,520,071 | B1 | 2/2003 | Lanza |
| 6,694,710 | B1 | 2/2004 | Wang |
| D506,214 | S * | 6/2005 | Zepter ..... D15/146 |
| 2004/0065051 | A1* | 4/2004 | Patterson et al. ..... 053/432 |
| 2004/0134359 | A1* | 7/2004 | Shiro' et al. ..... 99/472 |
| 2004/0173105 | A1* | 9/2004 | Kim et al. ..... 99/472 |

FOREIGN PATENT DOCUMENTS

| | | |
|---|---|---|
| EP | 1053945 A1 | 11/2000 |
| JP | 05-10211 | 2/1993 |
| JP | 2000-43818 | 2/2000 |
| WO | WO00/71422 | 11/2000 |

* cited by examiner

DECOUPLED VACUUM PACKAGING APPLIANCE

This application claims priority to U.S. Provisional Patent Application No. 60/492,035, entitled, "Decoupled Vacuum Packaging Machine" by Landen Higer and Alexandre A. N. Baptista, filed on Jul. 31, 2003, and which is hereby incorporated by reference in its entirety.

FIELD OF THE INVENTION

The present invention generally relates to vacuum packaging machines. More particularly, the invention is directed to appliance configurations that provide ease of use and convenient storage.

BACKGROUND

Vacuum packaging is a process for removing oxygen and other gases from food and other items that deteriorate in the presence gases. For example, food spoilage can occur due to oxidation and valuable manuscripts deteriorate when exposed to air. Metal objects can corrode or tarnish when exposed to moist air. Thus, food and other items can be vacuum packaged in a storage bag or storage container in order to increase either their "shelf life" or useful life. However, such appliances can be unwieldy and occupy too much counter space and/or storage space. Thus, there is a need for vacuum packaging appliances that are configured for both ease of use and convenient storage.

BRIEF DESCRIPTION OF THE DRAWINGS

The present invention is illustrated by way of example, and not by way of limitation.

DETAILED DESCRIPTION OF THE PREFERRED EMBODIMENT

An appliance for vacuum packaging storage bags and/or storage canisters is described. In the following description, for the purposes of explanation, numerous specific details are set forth in order to provide a thorough understanding of the present invention. It will be apparent, however, to one skilled in the art that the present invention may be practiced without these specific details. In other instances, well-known structures and devices are shown in block diagram form in order to avoid unnecessarily obscuring the present invention.

Figure 1A:
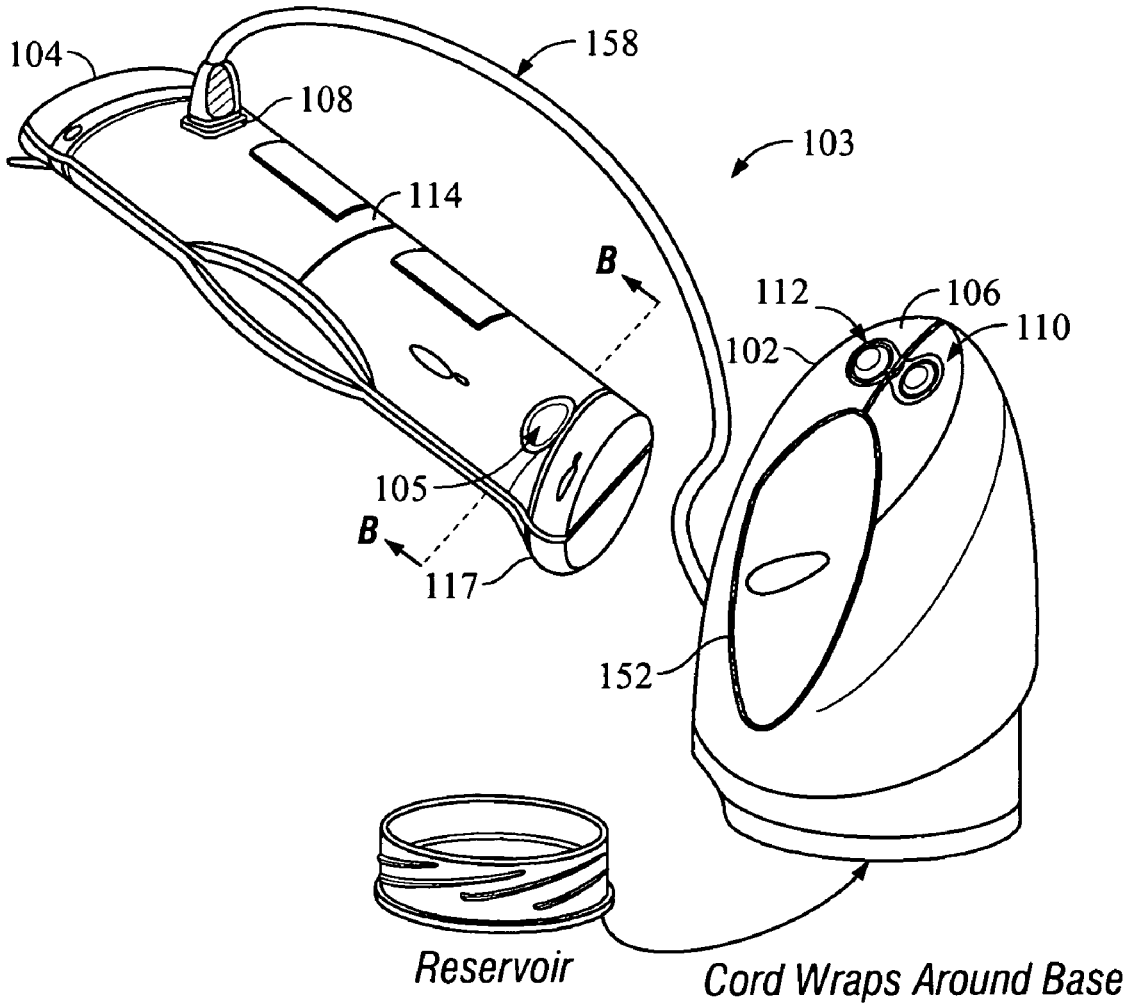
FIG. 1A is an isometric view that illustrates one embodiment of a vacuum packaging appliance with detachable wand.

FIG. 1A is an isometric view that illustrates certain embodiments of a vacuum packaging appliance with a wand. In FIG. 1A, the configuration of the vacuum packaging appliance 103 is one that allows for a small footprint. Base 102 includes a control panel 106 and a storage slot 152 for wand 104. Wand 104 is a separate unit that is decoupled from base 102. Wand 104 is also referred to herein as a receptacle unit.

Wand 104 includes a compartment 117 with a lid 114. Compartment 117 includes a vacuum chamber. The vacuum chamber includes a vacuum channel that is in communication with the vacuum pump in base 102 through vacuum hose/seal conductor 158. Further, the vacuum chamber includes one or more gaskets for statically sealing the vacuum chamber when the lid 114 is in the closed position. For example, there may be a gasket on compartment 117 surrounding the vacuum channel and/or a corresponding gasket on lid 114. Compartment 117 may optionally include a storage bag-cutter (not shown) integrated into lid or base, and a shelf mechanism for holding one or more rolls of storage bags. Further, wand 104 may include locks 105 that automatically lock during the sealing and/or vacuuming operation. Locks 105 are released in order to pop lid 114 open. Wand 104 also includes a vacuum-release mechanism for contacting the vacuum chamber with ambient atmosphere.

Base 102 includes a vacuum pump (not shown), sealing mechanism (not shown) and controls (not shown) associated with the operation of the vacuum pump and sealing mechanism.

According to certain embodiments, base 102 has a control panel 106 at the top frontal portion of the base. Control panel 106 includes an instant seal button 110 to manually start sealing a storage bag, and a vacuum button 112 to start removing gases from storage bags or canisters.

To explain, the sealing function may be automatically activated when the lid of wand 104 is in the closed position over one end of a storage bag, which end is not in a vacuum channel of the vacuum packaging appliance. When a storage bag is being evacuated through activation of the vacuuming function, the instant seal button may be used to seal a storage bag before a complete vacuum is created in the storage bag. This feature is useful when vacuum packaging fragile items so that such items do not get crushed. The sealing mechanism in base 102 activates a heating element in wand 104 through a seal conductor that is ganged with a vacuum hose, such as vacuum hose/seal conductor 158. The heating element may be in the form of a heating strip.

In addition, control panel 106 may include indicator lights to signal the start or completion of various processes such as the sealing process, vacuum process and/or machine reprogramming when transitioning from one process to the next. Control panel 106 may optionally include an automatic On/Off button. The automatic On/Off button acts as a fail-safe mechanism to ensure that the heat sealing and/or vacuum mechanisms are not unintentionally activated. Further, control panel 106 may optionally include a Cancel Button for canceling a given operation that is in progress.

Control panel 106 may also include a sealing time adjustment knob for controlling the heating element associated with the heat sealing mechanism. For example, the sealing time adjustment can be set to a first setting when storage bags are being sealed. The heat-sealing time adjustment can be set to a second setting when canisters are being sealed. In the case of sealing canisters, there is no need for activating the heating element.

In certain embodiments, the vacuum operation for removing gases automatically starts when the lid of wand 104 is in the closed position. In such cases, control panel 106 may include an Extended Vacuum Button. The Extended Vacuum Button may be used to extend the vacuum time to ensure that the maximum amount of air is removed, especially when using extra large storage canisters or bags.

Figure 1B:
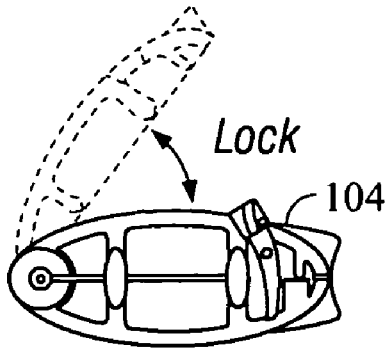
FIG. 1B is a transverse cross-sectional view through the detachable wand, taken in the direction of arrows A—A in FIG. 1A.

FIG. 1B is a transverse cross-sectional view through the wand 104, taken in the direction of arrows A—A in FIG. 1A.

Figure 1C:
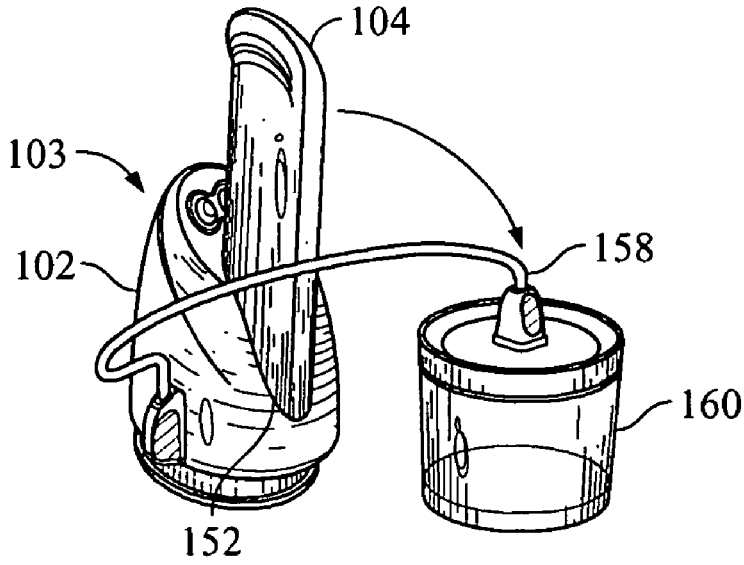
FIG. 1C is an isometric view that illustrates a storage configuration of a vacuum packaging appliance with detachable wand with storage canister.

FIG. 1C is an isometric view that illustrates a storage configuration of a vacuum packaging apparatus 103 with wand 104 and with storage canister 160. As shown in FIG. 1C, wand 104 may be conveniently stored in storage slot 152. The gases in storage canister 160 can be evacuated using vacuum hose 158 to connect storage canister 160 to a vacuum pump in base 102.

Storage bags and canisters may be used with the vacuum packaging appliance described above. Storage bags and rolls may be made from special 3-layer plastic material with channels that facilitate the removal of gases during the vacuum operation. The storage bags and rolls are reusable, washable and recyclable.

Storage canisters include a specially designed lid with a port for connecting to the vacuum pump of the vacuum packaging appliance through a hose attachment. The canister lids are designed to seal the canister once the gases are removed from the canister. The storage bags and canisters may be used to store food or other items for which vacuum packaging is desired.

A specially designed jar sealer may be used for vacuum packaging standard-mouth mason jars. The jar sealer is designed to fit mason jars and can be connected to the vacuum pump of the vacuum packaging appliance through a hose attachment. Similarly, bottle stoppers may be used to vacuum package bottles to extend the life of liquids. The stoppers are designed for connection to the vacuum pump of the vacuum packaging appliance through a hose attachment.

In the foregoing specification, embodiments of the invention have been described with reference to numerous specific details that may vary from implementation to implementation. Thus, the sole and exclusive indicator of what is the invention, and is intended by the applicants to be the invention, is the set of claims that issue from this application, in the specific form in which such claims issue, including any subsequent correction. Any express definitions set forth herein for terms contained in such claims shall govern the meaning of such terms as used in the claims. Hence, no limitation, element, property, feature, advantage or attribute that is not expressly recited in a claim should limit the scope of such claim in any way. The specification and drawings are, accordingly, to be regarded in an illustrative rather than a restrictive sense.

What is claimed is:

1. An appliance for vacuum packaging, said appliance comprising:

a base;

a receptacle unit comprising a lid, a vacuum chamber and a heating element, wherein said receptacle unit is a separate unit adapted for connecting to said base by an attachment hose during an evacuation procedure of said vacuum chamber associated with said appliance and wherein said receptacle unit is adapted for storage in an aperture in said base;

an evacuation mechanism for evacuating said vacuum chamber; and a heat sealing mechanism associated with said heating element for heat sealing an open end of a storage bag that is received in said receptacle unit;

wherein said evacuation mechanism is housed in said base.

2. The appliance of claim 1 further comprising a control panel.

3. The appliance of claim 1 further comprising a control panel that is an integral part of said base.

4. The application of claim 1 further comprising a control panel that is an integral part of said receptacle unit.

5. The appliance of claim 1 further comprising a control panel including:

a vacuum start control for manually starting an evacuation procedure for evacuating a vacuum chamber that resides in said receptacle unit; and an instant seal control for manually starting a heat sealing procedure to seal an open end of a storage bag received in said receptacle unit.

6. The appliance of claim 1 further comprising a sealing time adjustment knob for adjusting an amount of time for a heat sealing procedure during said vacuum packaging.

7. The appliance of claim 1 further comprising a vacuum-release mechanism for contacting said vacuum chamber associated with ambient atmosphere.

8. An appliance for vacuum packaging, further comprising:

a base;

a receptacle unit comprising a lid, a vacuum chamber and a heating element, wherein said receptacle unit is a separate unit adapted for connecting to said base by an attachment hose during an evacuation procedure of said vacuum chamber associated with said appliance and wherein said receptacle unit is adapted for storage in an aperture in said base;

an evacuation mechanism for evacuating said vacuum chamber; and a heat sealing mechanism associated with said heating element for heat sealing an open end of a storage bag that is received in said receptacle unit;

wherein said heat sealing mechanism is housed in said base for activating a heating element on said receptacle unit for heat sealing said open end of said storage bag.

9. The appliance of claim 8 further comprising a control panel.

10. The appliance of claim 8 further comprising a control panel including:

a vacuum start control for manually starting an evacuation procedure for evacuating a vacuum chamber that resides in said receptacle unit; and an instant seal control for manually starting a heat sealing procedure to seal an open end of a storage bag received in said receptacle unit.

11. The appliance of claim 8 further comprising a vacuum-release mechanism for contacting said vacuum chamber associated with ambient atmosphere.

12. An appliance for vacuum packaging, said appliance comprising:

a base;

a receptacle unit comprising a lid, a vacuum chamber and a heating element wherein said receptacle unit is a separate unit adapted for connecting to said base by an attachment hose during an evacuation procedure of said vacuum chamber associated with said appliance and wherein said receptacle unit is adapted for storage in an aperture in said base;

an evacuation mechanism for evacuating said vacuum chamber; and a heat sealing mechanism associated with said heating element for heat sealing an open end of a storage bag that is received in said receptacle unit;

wherein said base further comprises an accessory port for connecting to a storage container for purposes of evacuating said storage container.

13. The appliance of claim 12, wherein storage containers include canisters and mason jars.

14. An appliance for vacuum packaging storage bags and storage containers, said appliance comprising:

a base; and a receptacle unit detachable from said base;

wherein said receptacle unit comprises:

a vacuum chamber and a lid;

a heating element associated with a sealing mechanism;

wherein said base:

houses an evacuation mechanism associated with said vacuum chamber;

houses said sealing mechanism that activates said heating element through a seal conductor, wherein said seal conductor is detachable from said receptacle unit;

houses a control mechanism for operating said evacuation mechanism and said sealing mechanism; and includes a storage aperture for receiving one end of said receptacle unit when said receptacle unit is positioned vertically in said storage aperture; and wherein a frontal side of said receptacle unit is sized to receive an open end of a storage bag.

15. The appliance of claim 14 further comprising a control panel.

16. The appliance of claim 14 further comprising a control panel that is an integral part of said base.

17. The application of claim 14 further comprising a control panel that is an integral part of said receptacle unit.

18. The appliance of claim 14 further comprising a control panel including:

a vacuum start control for manually starting an evacuation procedure for evacuating a vacuum chamber that resides in said receptacle unit; and an instant seal control for manually starting a heat sealing procedure to seal an open end of a storage bag received in said receptacle unit.

19. The appliance of claim 14 further comprising a sealing time adjustment knob for adjusting an amount of time for a heat sealing procedure during said vacuum packaging.

20. The appliance of claim 14 further comprising a vacuum-release mechanism for contacting said vacuum chamber associated with ambient atmosphere.

* * * * *